US008375682B2

(12) United States Patent
Zanini et al.

(10) Patent No.: US 8,375,682 B2
(45) Date of Patent: Feb. 19, 2013

(54) GRIPPING APPARATUS FOR CAPPING ASSEMBLIES IN CONTAINER PACKAGING MACHINES

(75) Inventors: Gianpietro Zanini, Montanara di Curtatone (IT); Marco Baroni, Barbasso di Roncoferraro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 371 days.

(21) Appl. No.: 12/671,136

(22) PCT Filed: Jul. 30, 2008

(86) PCT No.: PCT/IB2008/002062

§ 371 (c)(1),
(2), (4) Date: Jan. 28, 2010

(87) PCT Pub. No.: WO2009/016501

PCT Pub. Date: Feb. 5, 2009

(65) Prior Publication Data

US 2010/0186349 A1 Jul. 29, 2010

(30) Foreign Application Priority Data

Aug. 2, 2007 (IT) ..... BO2007A0546

(51) Int. Cl.
*B67B 3/20* (2006.01)

(52) U.S. Cl. ..... 53/317; 53/331.5; 53/350

(58) Field of Classification Search ..... 53/317, 53/331.5, 75, 167, 331, 287, 318, 350; 248/266; 29/773; *B67B 3/14, 3/20*

See application file for complete search history.

(56) References Cited

U.S. PATENT DOCUMENTS 1,681,959 A * 8/1928 Tevander ..... 53/350
3,303,633 A * 2/1967 Wilhere ..... 53/317

(Continued)

FOREIGN PATENT DOCUMENTS

DE 3912324 A1 * 10/1990
EP 248145 A1 * 12/1987

(Continued)

OTHER PUBLICATIONS

Written Opinion and Search Report from counterpart PCT application, PCT/IB2008/002062, mailed Nov. 3, 2008, 10 pages.

*Primary Examiner* — Stephen F Gerrity

(74) *Attorney, Agent, or Firm* — Timothy J. Klima; Shuttleworth & Ingersoll, PLC

(57) ABSTRACT

Capping assemblies (2) of the type fitted to capping units (1*a*) in a machine for packaging containers filled with fluid or powdered products are equipped with a gripping apparatus (1) comprising a gripper (4) with three arms (5), each carrying an adapter (20) furnished with a pad (20*b*) offered in direct contact to the cap, through which the gripping action is applied. Each adapter (20) is secured to a fitting (17, 18) insertable into a socket (16) afforded by the bottom of a structural member (6) that forms the main part of each arm (5) and is hinged to the movable head of a relative capping assembly (2); when inserted into the structural member (6), the fitting (17, 18) is retained automatically by a snap lock mechanism (12) incorporated into the arm (5), which can be released subsequently by introducing the tip of a screwdriver into a slot (18*a*) created in the side of the fitting (17, 18) and levering the components apart.

10 Claims, 5 Drawing Sheets

U.S. PATENT DOCUMENTS

| | | | | | |
|---|---|---|---|---|---|
| 4,232,499 | A | * | 11/1980 | Holstein | 53/331.5 |
| 4,905,447 | A | * | 3/1990 | Margaria | 53/317 |
| 4,906,147 | A | * | 3/1990 | Friesinger et al. | 409/232 |
| 5,417,031 | A | * | 5/1995 | Bankuty et al. | 53/331.5 |
| 5,419,094 | A | * | 5/1995 | Vander Bush et al. | 53/75 |
| 5,467,527 | A | * | 11/1995 | Zanini et al. | 53/331.5 |
| 5,584,161 | A | * | 12/1996 | Zanini et al. | 53/317 |
| 5,778,633 | A | | 7/1998 | Sweeny | |
| 6,044,626 | A | * | 4/2000 | Harper et al. | 53/317 |
| 6,170,232 | B1 | | 1/2001 | VandeGeijn | |
| 6,945,011 | B2 | * | 9/2005 | Hidding et al. | 53/167 |
| 7,267,311 | B2 | * | 9/2007 | Jung | 248/266 |
| 7,343,720 | B2 | * | 3/2008 | Brown | 53/331.5 |
| 2009/0155315 | A1 | * | 6/2009 | Finkelmeier et al. | 424/400 |

FOREIGN PATENT DOCUMENTS

| | | | | |
|---|---|---|---|---|
| EP | 1273551 | | | 1/2003 |
| FR | 2629440 | A1 | * | 10/1989 |
| GB | 2268165 | | | 1/1994 |
| GB | 2332195 | | | 6/1999 |
| JP | 01023986 | A | * | 1/1989 |
| JP | 09272594 | A | * | 10/1997 |

* cited by examiner

GRIPPING APPARATUS FOR CAPPING ASSEMBLIES IN CONTAINER PACKAGING MACHINES

CROSS-REFERENCE TO RELATED APPLICATIONS

This application is the National Phase of International Application PCT/IB2008/002062 filed Jul. 30, 2008 which designated the U.S. and that International Application was published under PCT Article 21(2) in English.

This application claims priority to Italian Patent Application No. BO2007A000546 filed Aug. 2, 2007, and PCT Application No. PCT/IB2008/002062 filed Jul. 30, 2008, which applications are incorporated by reference herein.

TECHNICAL FIELD

The present invention relates to a gripping apparatus for capping assemblies, and in particular, an assembly of the type utilized in the capping units of machines for packaging containers.

In particular, the present invention finds application in the packaging of containers designed to hold substances and/or products of liquid, viscous, creamy, gelatinous and/or powder consistency.

BACKGROUND ART

Conventionally, caps are applied automatically to respective containers by machine units equipped generally with a plurality of capping assemblies, set in motion by a carousel or similar supporting structure in such a way as to revolve around a vertical axis of rotation.

In addition, each assembly is generally rotatable about a respective axis parallel to the vertical axis of the carousel, and capable also of axial motion on the carousel in such a way as to move toward or away from a corresponding container moving as one with the carousel.

Each capping assembly is equipped normally with a respective gripping apparatus, typically a conventional gripper or a similar device, by which a screw cap can be taken up, held and twisted onto the threaded neck of a respective container when a moving part of the capping assembly is set in rotation.

In general, an apparatus of the type in question presents two or more arms, each hinged to a bottom end of the relative capping assembly in such a way that a pivoting movement on the hinge pin will cause a gripping end of the arm to move in and toward or out and away from the rotational axis of the assembly. It will be clear that the inward or outward movement of each arm occurs simultaneously with the inward or outward movement of the other arms, in such a way as will cause the gripper to contract and tighten, or to spread open.

The free end of each arm is fitted with a rubber pad positioned to engage in direct contact with a lateral cylindrical portion of a cap about to be applied to the neck of a filled container advancing on the carousel.

The part of the rubber portion designed to engage the cap is generally of arcuate geometry, presenting a profile substantially matched to the outer lateral profile of the cap currently in use.

The rubber pad is fixed generally to an adapter that will be mounted to a relative structural member of the corresponding gripper arm by means of two or more fixing screws so that it can be removed and replaced with an adapter having a structurally different gripping pad, that is to say, of shape and/or dimensions dissimilar to the shape and/or dimensions of the gripping pad presented by the adapter removed from the arm, or alternatively, in the event of wear or damage, replaced with a new adapter presenting the same structural characteristics as the one removed.

Whilst the gripping apparatuses currently in use are able to apply caps to containers satisfactorily, the applicant finds nonetheless that they are not entirely free of drawbacks and could be improved in a number of respects, mainly with regard to the simplicity and practicality of the operation by which the adapters presenting the rubber pads are removed from and refitted to the arms of the gripper, but with regard also to the time needed to carry out the steps of removing and fitting the adapters, and the cost disadvantages connected with these same removal and refitment operations.

In particular, the operations of removing and refitting the aforementioned adapters involve unfastening or fastening two or more fixing screws for each arm of each gripper operating on the capping units currently in use. Consequently, given the appreciable number of grippers normally in operation on conventional capping units, and therefore the appreciable number of single arms carrying respective adapters, these removal and refitment procedures tend to be significantly long and somewhat impractical. In effect, such procedures necessarily involve loosening or tightening all of the fixing screws present on the arms of each apparatus, one by one. The operations in question represent an even greater burden when there is a change of production size involved, in other words, a changeover requiring the replacement of all the adapters in use on the grippers of a given capping unit with others presenting rubber pads of different size and shape, suitable for handling caps that are structurally dissimilar to those utilized in production previously. In this instance, a size changeover requires twice the time needed for a straight replacement, since the procedure involves undoing all the fixing screws to effect the complete removal of all the existing adapters, then positioning all of the adapters for the new size or style of cap and retightening all the fixing screws needed to clamp the repositioned adapters.

The same problem arises when, as a result of the rubber pads becoming worn and degraded, the adapters installed originally with the gripper arms need to be renewed completely by fitting replacement adapters with fresh rubber pads.

Moreover, given the complexity of the prior art capping units in question, the operating space needed to effect the removal and/or refitment of the adapters is somewhat limited, with the result that the tasks of loosening and/or tightening clamp screws employing conventional instruments, equipment and/or tools such as keys, screwdrivers and the like, tend to be obstructed and consequently prolonged.

Finally, it will be appreciated that these tasks can be carried out on capping units only when not in operation. Indeed in practice, the capping units are shut down by suspending the entire packaging process temporarily. Self-evidently, every time the adapters of the gripping apparatus need to be replaced or renewed, the operation impacts significantly on the cost of capping the containers, as a proportion of overall production costs.

To overcome the drawbacks associated with the removal and/or refitment of these gripper adapters, it is the common practice to procure a broad selection of capping assemblies equipped with components configured for caps of different sizes and styles, so that when the need arises to effect a size changeover or to renew worn parts, this can be achieved more simply by replacing the entire gripping assembly rather than the single adapters. With this strategy, the operation of the capping units can be restored more quickly when interrupted momentarily, and the adapters of any assemblies removed from the line can be replaced as required, and at leisure. However, the expedient of preparing numerous sets of gripper assemblies each dedicated to a particular cap size, simply in order to minimize down time during the production cycle, is economically expensive and has little advantage.

DISCLOSURE OF THE INVENTION

The main object of the present invention is to overcome the problems associated with the prior art.

One object of the invention, in particular, is to provide a gripping apparatus for capping assemblies such as will facilitate and expedite the operations of replacing the adapters of the gripping mechanism, whether for the purpose of effecting a changeover from one size or style of cap to another, or of renewing worn or degraded parts.

A further object of the invention is to achieve a significant reduction in the costs incurred routinely by replacing the adapters of conventional gripping apparatus, shortening the interval of time for which the production cycle must be suspended in order to effect the replacement.

The stated objects, and others that will become apparent in the course of the specification, are substantially realized according to the invention in a gripping apparatus for capping assemblies, of the type, in particular, fitted to the capping units of machines for packaging containers, of which the essential features are recited in the characterizing section of claim 1.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

With reference to the figures of the accompanying drawings, the present invention relates to a gripping apparatus for capping assemblies, denoted 1 in its entirety, of the type fitted to the capping units of machines for packaging containers, in particular.

Figure 1:
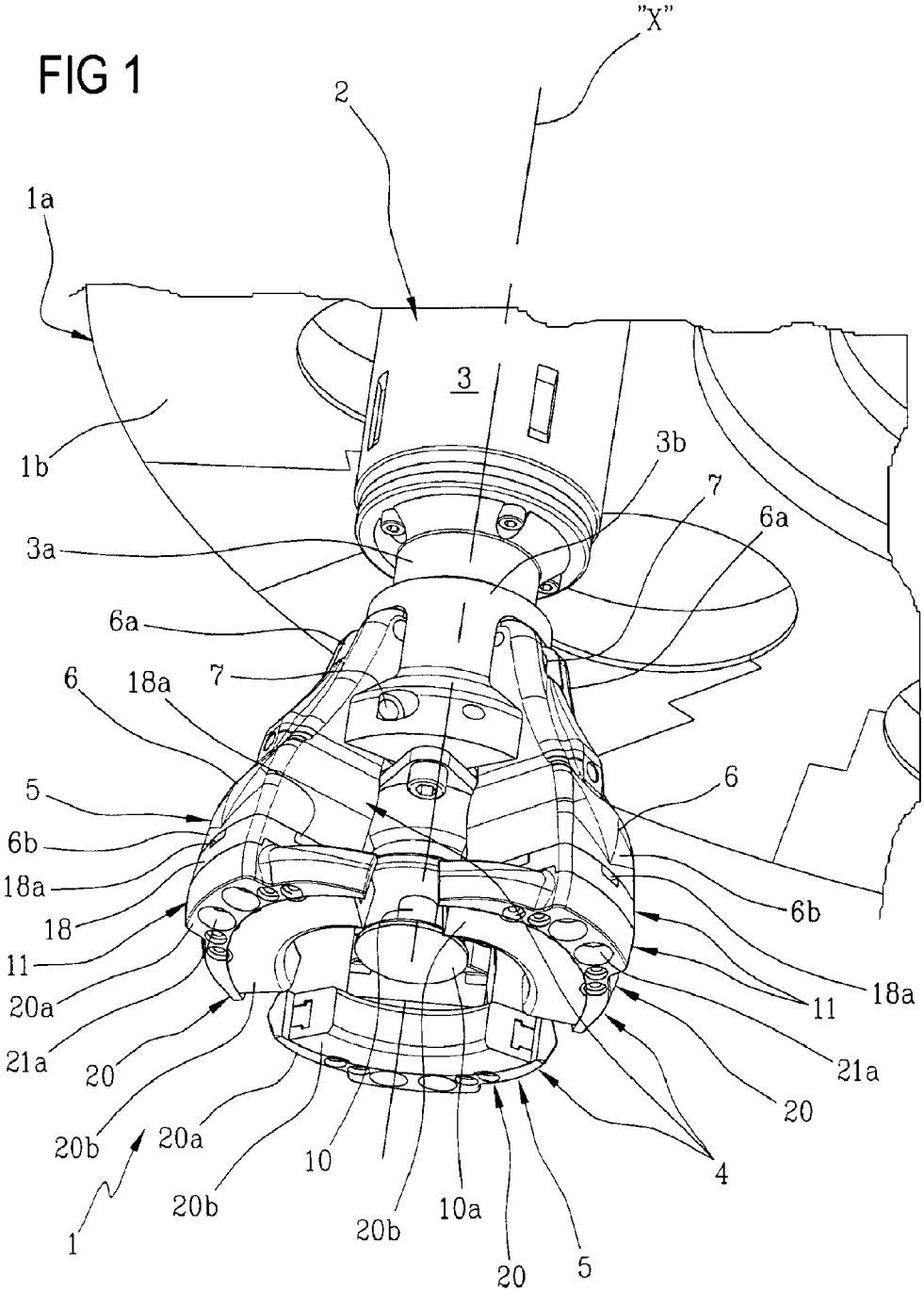
FIG. 1 shows a gripping apparatus according to the present invention, viewed in perspective from beneath, mounted to a capping assembly of the type utilized in particular on the capping units of machines for packaging containers.
Figure 2:
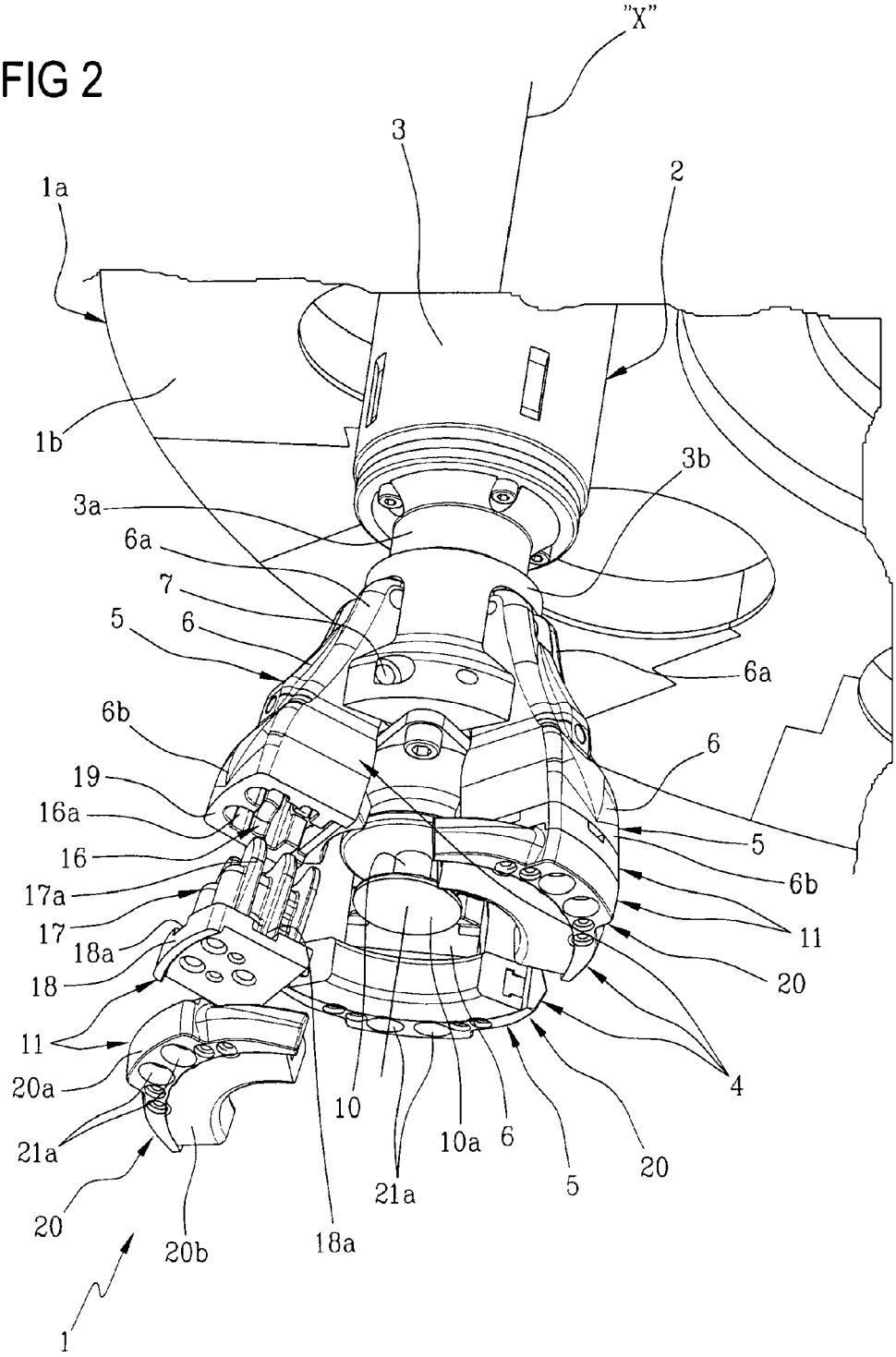
FIG. 2 shows the apparatus of FIG. 1, likewise in perspective from beneath, with one component part illustrated in an exploded view.

Generally speaking, containers designed to hold products of varying description, for example liquid, viscous, creamy, gelatinous and/or powdered substances, are filled and closed on machines (not illustrated, being conventional in embodiment) equipped with at least one capping unit 1*a*, indicated fragmentarily in FIGS. 1 and 2, by which caps or tops (not illustrated) are fitted automatically to respective containers (not illustrated) ready for closing.

Such capping units 1*a* are equipped normally with a plurality of capping assemblies 2 (FIGS. 1, 2 and 4), mounted peripherally to supporting structures or carousels 1*b*, indicated fragmentarily in FIGS. 1 and 2, and arranged in a circumferential ring centred on a preferably vertical axis of rotation (not illustrated). Each capping unit 1*a* is equipped preferably with suitable drive means (not illustrated) by which the relative structure or carousel 1*b* is set in rotation together with the associated capping assemblies 2 about the aforementioned vertical axis.

To advantage, each capping assembly 2 presents at least one anchored section (not shown in the accompanying drawings) fastenable to the supporting structure 1*b* of the relative capping unit 1*a*, and at least one movable section 3 with freedom of translational movement, which is slidable on the anchored section between a first position, distanced from a respective container, and a second position of close proximity to the container. The movable section 3 of each capping assembly 2 is able also to rotate on its own longitudinal axis "X", in such a way that screw caps can be twisted by the single assemblies onto the respective containers.

Figure 3:
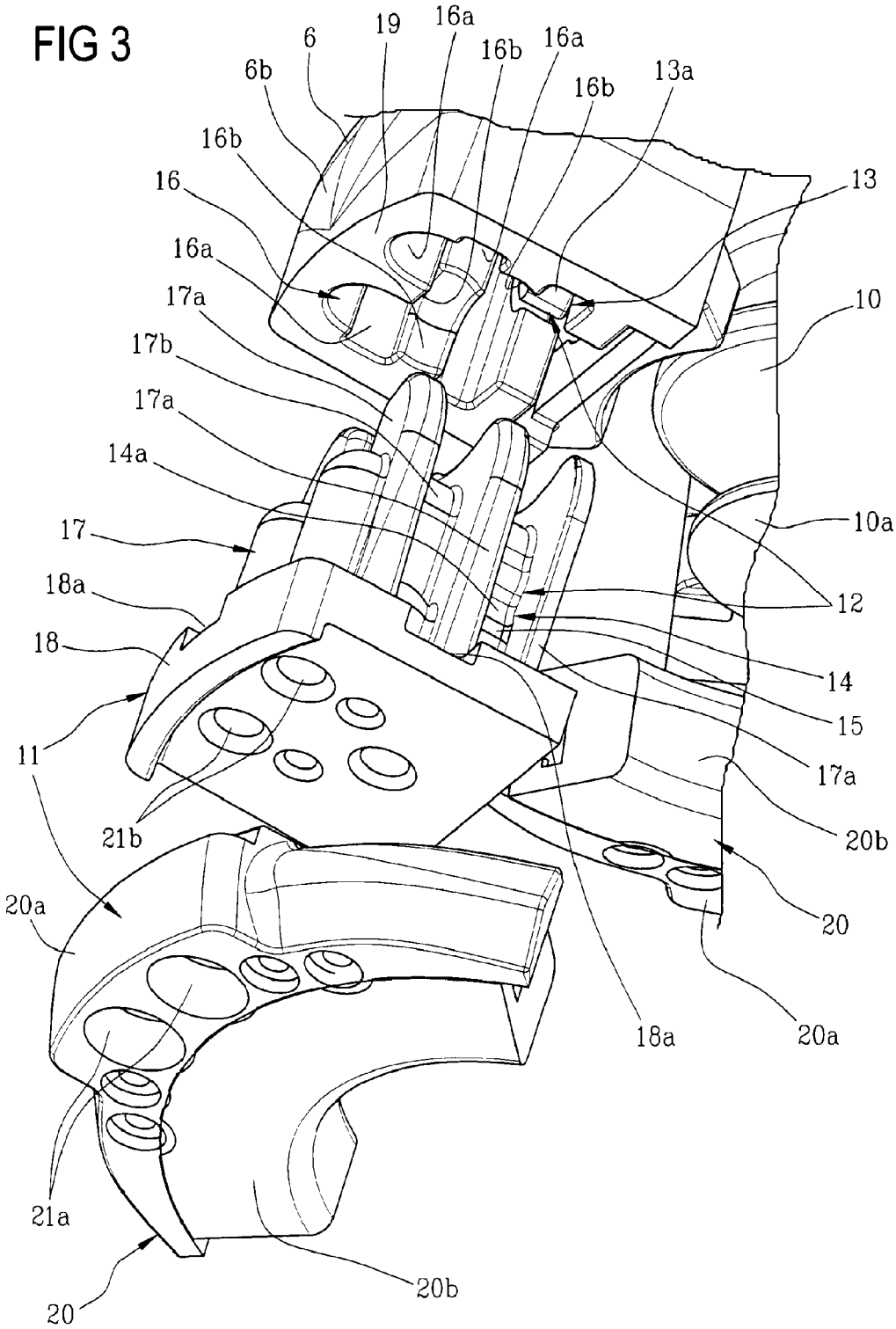
FIG. 3 is an enlargement of the exploded detail illustrated in FIG. 2.

As illustrated in FIGS. 1 to 3, the gripping apparatus 1 according to the invention is associated operatively with a free end 3*a* presented by the movable section 3 of the relative capping assembly 2, remote from the aforementioned anchored section. In particular, the apparatus 1 according to the invention comprises at least one gripper 4 operatively associated with the respective capping assembly 2 and capable of movement on the assembly between a position of engagement, in which a cap is gripped and held, and an at-rest position, in which no cap is engaged.

The gripper 4 is furnished with at least two retaining arms 5, each presenting at least one structural member 6 attached pivotably to the respective capping assembly 2.

In the example of FIGS. 1 and 2, the gripper 4 is equipped advantageously with three such retaining arms 5 equispaced angularly about the longitudinal axis "X" of the capping assembly 2, that is to say, at intervals of 120° one from the next.

It will be appreciated at all events that the scope of the present invention is not limited in any way by the number of arms 5 incorporated into the gripper 4, which might be more in number than the three described and illustrated, and therefore equispaced at angles less than 120°.

Figure 4:
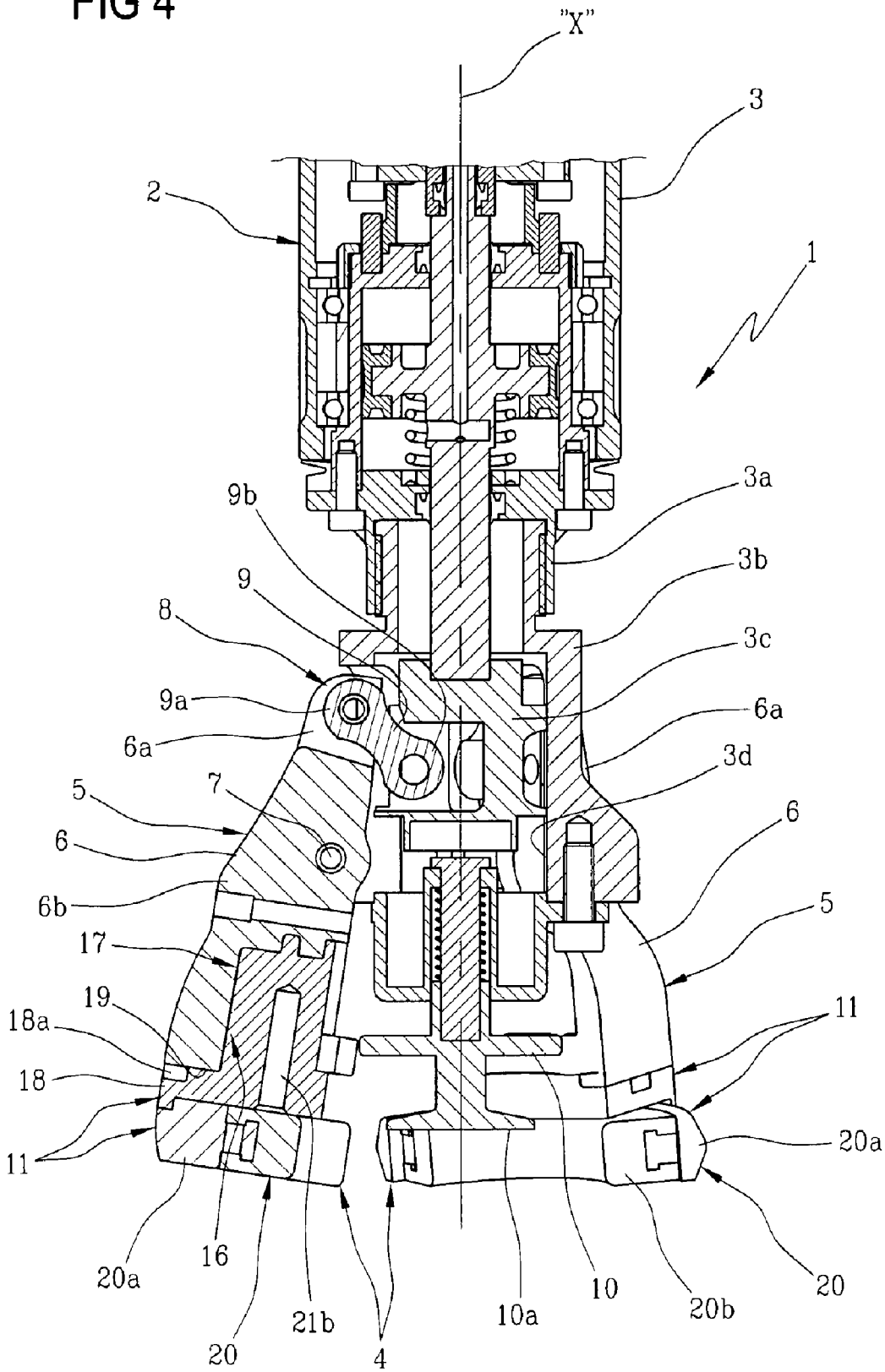
FIG. 4 is a sectional illustration of the apparatus shown in FIGS. 1, 2 and 3, taken on a longitudinal cutting plane through a capping assembly equipped with the selfsame apparatus of FIGS. 1, 2 and 3.

As illustrated in FIGS. 1, 2 and 4, the structural member 6 of each retaining arm 5 is preferably hinged by way of a relative pivot 7, at a point substantially mid-way along its length, to a head 3*b* presented by the movable section 3 of the relative capping assembly 2. In this way, the structural member 6 of each arm 5 is free to rock on a preferably horizontal axis established by the pivot 7.

To advantage, as illustrated in FIG. 4, the rocking motion of the structural member 6 is induced by a lever linkage 8 interposed operatively between a top end 6*a* of each structural member 6 and a vertically slidable collar 3*c* housed operatively in a recess 3*d* afforded by the head 3*b* of the movable section 3 associated with the capping assembly 2.

In particular, the linkage 8 comprises a rod 9 of which a first end 9*a* is hinged to the top end 6*a* presented by the structural member 6 of the respective arm 5, and a second end 9*b* is hinged to the collar 3*c*. The collar 3*c* is connected operatively to a locating element 10 positioned below the head 3*b* of the respective capping assembly 2. The locating element 10 presents a restraint surface 10*a* at the bottom, designed to interact with the top face of a cap held by the gripper in such a way that the collar 3*c* will be forced toward the movable section 3 of the respective capping assembly 2, that is to say upwards. The upward sliding movement of the collar 3*c* has the effect of inducing an angular displacement in each rod 9, which pushes the top end 6*a* of the relative structural member 6 away from the head 3*b* of the movable section 3 connected to the capping assembly 2, causing the respective arm 5 to rock on its pivot 7. Conversely, when the locating element 10 is free to return to its original position, the collar 3*c* will shift downwards, with the result that the top end 6*a* of the structural member 6 is drawn by the rod 9 back toward the head 3*b*, again causing the respective arm 5 to rock on its pivot 7.

Referring to FIGS. 1 and 2, the upward motion of the locating element 10 occasioned by interaction with a cap will cause all the arms 5 of the gripper 4 to rock on their pivots simultaneously, with the result that the free ends of the arms close on the cap and the cap is held tight. In the absence of any interaction with a cap, on the other hand, the arms 5 of the gripper 4 are able simultaneously to spread and assume the aforementioned at-rest position.

As discernible in the accompanying drawings, each retaining arm 5 is furnished with a contact element 11 associated removably with the relative structural member 6, at the end remote from the head 3*b* of the capping assembly 2, positioned to interact directly and laterally with a cap when the gripper 4 is in the aforementioned position of engagement, that is to say when the structural members 6 of the arms 5 are caused to rock on their pivots by the upward movement of the locating element 10.

In order to keep the structural member 6 and the contact element 11 of each retaining arm 5 firmly and securely associated one with another, each arm 5 is equipped with automatic locking means 12 (FIGS. 3, 5 and 6) by which the contact element 11 is engaged and held tight when offered to the structural member 6.

Advantageously, the automatic locking means 12 can be operated from externally of the gripper to release the contact element 11 from the structural member 6 and separate the two parts by distancing one from the other.

Preferably, the automatic locking means 12 in question comprise a snap lock mechanism, so that when a contact element 11 and a respective structural member 6 are brought together, the two components can fasten together automatically, with no requirement for any additional locking action such as tightening screws or performing other comparable fastening operations.

In particular, the automatic locking means 12 comprise a first locking member 13 associated with the structural member 6 and a second locking member 14 associated with the contact element 11. The first and second locking members 13 and 14 combine automatically to keep the contact element 11 associated with the relative structural member 6, and can be separated forcibly, for example by applying external mechanical pressure, in order to disconnect and distance the parts one from another.

In a preferred embodiment, the first locking member 13 comprises at least one coupling element 13*a* operatively associated with the respective structural member 6, and the second locking member 14 presents at least one coupling seat 14*a* incorporated into the contact element 11. The coupling element 13*a* is displaceable between a first position, in which the contact element 11 has freedom of movement toward or away from the relative structural member 6, and a second position, in which the freedom of the contact element 11 to move toward or away from the structural member 6 is impeded at least in part by the selfsame coupling element 13*a*.

Figure 6:
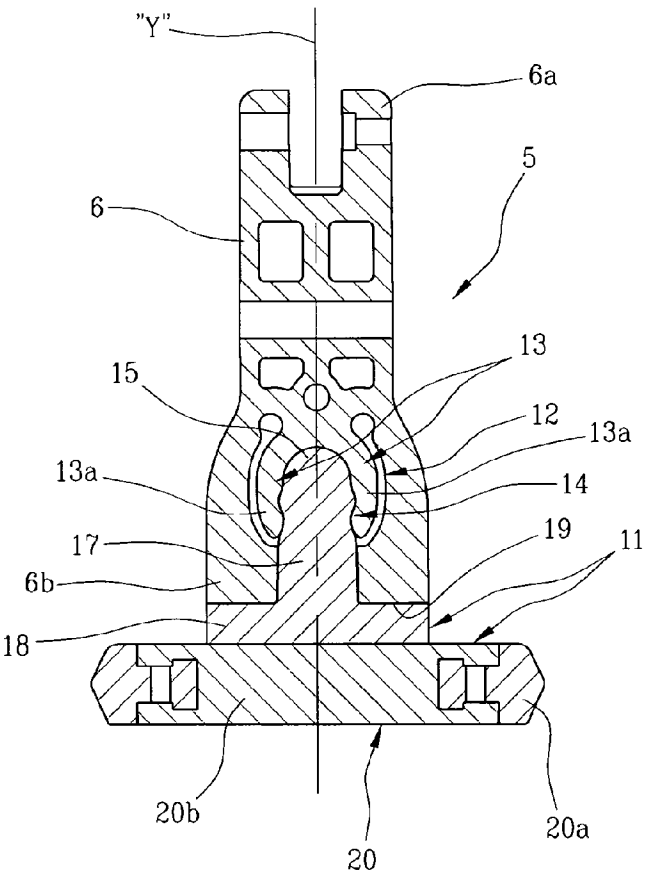
FIG. 6 is a sectional illustration similar to that of FIG. 5, showing the arm assembled.
Figure 5:
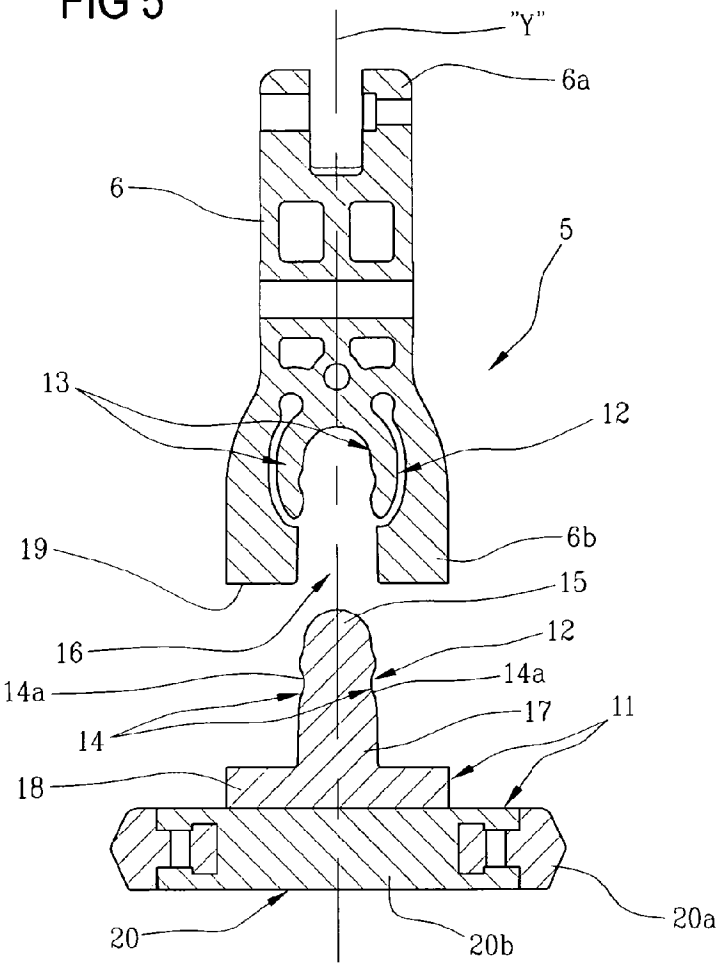
FIG. 5 shows an arm of the apparatus illustrated in FIGS. 1 to 4, disassembled in part and viewed in section.

According to the solution illustrated in FIGS. 5 and 6, the first locking member 13 comprises at least one pair of coupling elements 13*a* operatively associated with the relative structural member 6, whilst the second locking member 14 comprises at least one pair of coupling seats 14*a* incorporated into the relative contact element 11.

As illustrated in FIGS. 5 and 6, the coupling elements 13*a* occupy substantially a common plane, presenting symmetrical profiles on either side of a predetermined axis denoted "Y", in such a manner as to define a coupling yoke of which the free ends converge toward the axis of symmetry "Y". In keeping with the type of locking action envisaged, the coupling seats 14*a* likewise occupy substantially a common plane, presenting symmetrical profiles on either side of a predetermined axis that will coincide preferably with the axis of symmetry "Y" of the coupling elements 13*a* when the contact element 11 is joined to the corresponding structural member 6.

To advantage, the coupling elements 13*a* are able to alternate between a first position, in which they are spread apart one from another and the contact element 11 has complete freedom of movement toward or away from the relative structural member 6, and a second position, in which the freedom of the contact element 11 to move toward or away from the structural member 6 is impeded at least in part.

In greater detail, at least one of the coupling elements 13*a*, and preferably both, will be elastically deformable, whilst at least one and preferably both of the coupling seats 14*a* will be incorporated into a rigid portion 15 of the contact element 11 (FIGS. 3, 5 and 6). The coupling elements 13*a* are thus displaceable from the first position to the second position as a result of being parted forcibly by the contact element 11 when this same element is moved toward or away from the relative structural member 6. Both coupling elements 13*a* are displaceable from the second to the first position as a result of recovering their shape elastically, either when the locking means are assembled and the free ends locate in the relative coupling seats 14*a*, or when the locking means are separated and the free ends no longer encounter resistance from the rigid portion 15 presenting the selfsame seats 14*a*.

As illustrated in FIGS. 3, 5 and 6, the first locking member 13 is housed operatively within a socket 16 afforded by a bottom end 6*b* of the relative structural member 6, remote from the aforementioned top end 6*a*. The second locking member 14 is associated preferably with a projection 17 afforded by the contact element 11 (FIGS. 2 and 3).

To ensure an accurate coupling action when the contact element 11 is inserted into the relative structural member 6 of each arm 5, the aforementioned socket 16 and the projection 17 of the two parts are fashioned with substantially interlocking profiles. In this way, a perfectly tight fit is guaranteed between the projection 17 of the contact element 11 and the socket 16 of the structural member 6.

Preferably, the rigid portion 15 affording the coupling seats 14*a* is presented by the projection 17 of the relative contact element 11. To advantage, the projection 17 of each contact element 11 is effectively one and the same as the rigid portion 15 presenting the coupling seats 14*a*.

With reference to the example illustrated in FIGS. 2 and 3, the socket 16 of each structural member 6 presents a plurality of internal cavities 16*a* and a plurality of internal ribs 16*b* combining to create a substantially convoluted and irregular internal profile. Similarly, the projection 17 of the respective contact element 11 presents a plurality of external ribs 17*a* and a plurality of external cavities 17*b* positioned respectively to engage the internal cavities 16*a* and the internal ribs

16*b* presented by the socket 16 of the structural member 6, when the contact element 11 is coupled to the selfsame member 6.

Thanks to the interlocking action of the internal cavities and ribs 16*a* and 16*b* presented by the sockets 16 and the external ribs and cavities 17*a* and 17*b* presented by the matching projections 17, the connections between the contact elements 11 and the relative structural members 6 are invested with a high degree of stability and resistance to the centrifugal forces generated typically during the step of screwing caps onto containers.

Still with reference to the accompanying drawings, each contact element 11 presents an abutting portion 18 designed to register with a mating surface 19 around the socket 16 of the structural member 6.

To facilitate the operation of separating the contact element 11 from the respective structural member 6, the abutting portion 18 presents at least one lateral slot 18*a*, and preferably a plurality of lateral slots 18*a*, affording a purchase by means of which the contact element 11 can be forced in a direction away from the relative structural member 6. More exactly, as discernible in FIGS. 1 to 4, each slot 18*a* is delimited by surfaces of the abutting portion 18 and by the mating surface 19 of the structural member 6 when the contact element 11 is joined to this same member.

To remove the contact element 11 from the relative structural member 6, the tip of a convenient implement or hand tool, such as a screwdriver or the like, must be inserted into at least one slot 18*a* of the abutting portion 18, whereupon the necessary force can be applied to ease the contact element 11 away from the structural member 6. In other words, the surfaces of each slot 18*a* provide respective bearings against which leverage can be applied, using a suitable tool, to the end of detaching the contact element 11 from the structural member 6 with which it is associated.

To advantage, each contact element 11 presents a gripping adapter 20 attachable removably to the side of the abutting portion 18 remote from the projection 17. The gripping adapter 20 presents at least a structural element 20*a* fastenable to the abutting portion 18 with one or more threaded elements (conventional in embodiment, and therefore not illustrated) inserted operatively through respective openings 21*a* and 21*b*, preferably threaded, afforded respectively by the structural element 20*a* of the adapter 20 and by the side of the abutting portion 18 remote from the projection 17.

As illustrated in the drawings, each gripping adapter 20 also presents a contact pad 20*b*, embodied preferably in a material with a high coefficient of friction, such as rubber or the like, designed to engage the outer surface of the particular cap employed in production.

Advantageously, each contact pad 20*b* presents an arcuate surface, adaptable to the outer lateral curvature of the caps being handled and fitted. The contact pad 20*b* is preferably co-moulded in one piece with the structural element 20*a*, in such a way as to obtain a monolithic component.

The drawbacks associated with the prior art are overcome according to the present invention, and the stated objects duly realized. First and foremost, the automatic locking system incorporated into each arm of the gripper allows a swift and simple attachment of a contact element with the selected contact pad to the structural member, as well as a speedy and easily accomplished separation of the contact element from the selfsame structural member. With the inclusion of the automatic locking means, in particular, the contact element, together with the associated adapter and contact pad, can be detached quite simply with the aid of a suitable implement or tool, such as a screwdriver or the like. In effect, by inserting the screwdriver from one side into one of the slots afforded by the abutting portion of the contact element fitted to each arm, and twisting the tip internally of the slot, pressure can be applied in such a way as to lever the selfsame contact element away from the structural member to which it is attached. Conversely, to attach a contact element to the structural member of a relative gripper arm, the selfsame contact element is simply offered to the structural member and pushed home. The pushing force, which can be applied manually, must be sufficient to overcome the resistance of the coupling elements located within the socket of the structural member and opposing the insertion of the projection presented by the contact element. Once the coupling elements of the yoke give way to the force applied through the contact element, they will flex and spread, allowing the projection to penetrate the socket fully and correctly. In this situation the coupling elements are able to snap into place, occupying the coupling seats of the automatic locking means and thus securing the contact element to the structural member of the relative gripper arm.

Self-evidently, with the locking system disclosed, the procedure of changing from one size or style of cap to another is greatly expedited and simplified, as also is the straightforward replacement of worn or degraded contact pads.

The effect of speeding up these operations is to achieve a notable saving in time, and consequently a significant reduction in the costs of capping containers filled with liquid or powder products.

It will be appreciated also that the operations involved in replacing the adapters are expedited similarly by the positioning of the slots on the contact element, which are easily accessible. Moreover, with slots provided on three sides of each arm presented by each gripper apparatus, the locking mechanism can be released applying the necessary force from three different positions.

What is claimed is:

1. A gripping apparatus for capping assemblies in container packaging machines, comprising at least one gripper movable on a relative capping assembly between a position of engagement, in which a cap is gripped and held by the gripper, and an at-rest position, in which no cap is engaged by the gripper, the gripper having at least two retaining arms, each having at least one structural member attached pivotably to a respective capping assembly, and at least one contact element associated removably with the at least one structural member, positioned to interact directly with a cap when the gripper is in the position of engagement, wherein each retaining arm of the gripper includes an automatic locking mechanism by which the at least one structural member and the corresponding contact element are held securely and stably together when joined one to another;

wherein the automatic locking mechanism can be separated forcibly by applying external pressure to disconnect and distance the structural member and the contact element one from another;

wherein the automatic locking mechanism is operated from externally of the gripper to make the contact element disengage from the structural member by distancing one from the other.

2. The gripping apparatus of claim 1, wherein the automatic locking mechanism comprises a snap lock mechanism, operating in such a way that when the structural member of the arm and the respective contact element are joined together, the contact element will be secured to the structural member by a snap locking action of the mechanism.

3. The gripping apparatus of claim 2, wherein the automatic locking mechanism comprises a first locking member associated with the structural member, and a second locking member associated with the contact element, of which the first locking member comprises at least one pair of coupling elements operatively associated with the relative structural member and combining to fashion a yoke, and the second locking member comprises at least one pair of coupling seats afforded by the relative contact element, occupying substantially a common plane and having symmetrical profiles on either side of a predetermined axis coinciding with an axis of symmetry of the coupling elements when the contact element is joined to the corresponding structural member.

4. The gripping apparatus of claim 3, wherein the coupling elements of the first locking member are elastically deformable and alternately movable between a first position, in which the contact element has freedom of movement toward or away from the relative structural member, and a second position in which the freedom of the contact element to move toward or away from the structural member is impeded at least in part by the coupling elements, whilst the coupling seats of the second locking member are presented by a rigid portion of the contact element, in such a way that the coupling elements are displaceable from the first position to the second position as a result of being parted forcibly by the contact element when this contact element is moved toward or away from the relative structural member, and displaceable from the second position to the first position as a result of recovering their shape elastically when encountering no further resistance from the second locking member.

5. The gripping apparatus of claim 1, wherein the contact element includes an abutting portion interfaced with the structural member of the relative arm, and a gripping adapter attachable removably to a side of the abutting portion opposite to a side interfacing with the structural member, comprising at least one structural element, and at least one contact pad of a material having a high coefficient of friction, for engaging the outer surface of a cap.

6. Apparatus as in claim 5, wherein the gripping adapter is attachable to the abutting portion by at least one threaded fastener.

7. The gripping apparatus of claim 5, wherein the contact pad and the structural element are fashioned as a single piece by co-molding.

8. A capping assembly for capping units of container packaging machines, comprising:

at least one anchored section fastenable to a supporting structure of a capping unit in a machine for packaging containers;

at least one movable section translatable between a first position, distanced from a respective container, and a second position of close proximity to the container, and rotatable also about its own longitudinal axis, a gripping apparatus as in claim 1, fitted to an end of the movable section remote from the anchored section.

9. A capping unit for container packaging machines, comprising:

a supporting structure turning on a central axis of rotation;

a drive mechanism operatively associated with the supporting structure, by which the supporting structure is set in motion about the central axis of rotation, comprising a plurality of capping assemblies as in claim 8, mounted to the supporting structure and arranged circumferentially about the central axis of rotation of the supporting structure.

10. A machine for packaging containers, comprising at least one capping unit as in claim 9.

* * * * *